US009928793B2

(12) United States Patent
Zhao et al.

(10) Patent No.: US 9,928,793 B2
(45) Date of Patent: Mar. 27, 2018

(54) SCANNING DRIVING CIRCUIT

(71) Applicant: WUHAN CHINA STAR OPTOELECTRONICS TECHNOLOGY CO., LTD., Wuhan (CN)

(72) Inventors: Mang Zhao, Wuhan (CN); Juncheng Xiao, Wuhan (CN); Yong Tian, Wuhan (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 257 days.

(21) Appl. No.: 14/785,043

(22) PCT Filed: Aug. 10, 2015

(86) PCT No.: PCT/CN2015/086459

§ 371 (c)(1),
(2) Date: Oct. 16, 2015

(87) PCT Pub. No.: WO2017/020327

PCT Pub. Date: Feb. 9, 2017

(65) Prior Publication Data

US 2017/0162149 A1 Jun. 8, 2017

(30) Foreign Application Priority Data

Aug. 4, 2015 (CN) ..... 2015 1 0469551

(51) Int. Cl.
*G09G 3/36* (2006.01)

(52) U.S. Cl.
CPC ..... *G09G 3/3677* (2013.01); *G09G 3/3696* (2013.01); *G09G 2300/043* (2013.01)

(58) Field of Classification Search
CPC ..... G09G 3/36–3/3696; G09G 2310/0264–2310/0297
See application file for complete search history.

(56) References Cited

U.S. PATENT DOCUMENTS

2003/0231735 A1* 12/2003 Moon ..... G09G 3/3685 377/64
2012/0105398 A1* 5/2012 Park ..... H03K 19/01852 345/206

(Continued)

FOREIGN PATENT DOCUMENTS

CN 104064145 A 9/2014
CN 104078019 A 10/2014

(Continued)

*Primary Examiner* — Sanghyuk Park
(74) *Attorney, Agent, or Firm* — Hauptman Ham, LLP

(57) ABSTRACT

The present invention provides a scanning driving circuit for executing a driving operation to cascaded scanning lines, the scanning driving circuit includes a pull-down control module, a pull-down module, a reset module, a down link module, a first bootstrap capacitor, a constant low voltage level source, and a constant high voltage level source; wherein a cascading manner of the clock signal is determined according to a scanning order of the scanning driving circuit, for the reset module to pull up the corresponding scanning signal of the scanning line. The structure of the scanning driving circuit of the present invention is simple and highly dependable.

18 Claims, 5 Drawing Sheets

(56) References Cited

U.S. PATENT DOCUMENTS

| | | | | |
|---|---|---|---|---|
| 2014/0062848 | A1 | 3/2014 | Jinta | |
| 2015/0364084 | A1 | 12/2015 | Gu et al. | |
| 2016/0055829 | A1* | 2/2016 | Lin | G09G 3/3233 345/213 |
| 2016/0180788 | A1 | 6/2016 | Xiao | |
| 2016/0189648 | A1 | 6/2016 | Xiao | |
| 2016/0247442 | A1 | 8/2016 | Dai et al. | |
| 2016/0267832 | A1 | 9/2016 | Dai | |

FOREIGN PATENT DOCUMENTS

| | | | |
|---|---|---|---|
| CN | 104485079 | A | 4/2015 |
| CN | 104505049 | A | 4/2015 |
| CN | 104575420 | A | 4/2015 |

* cited by examiner

SCANNING DRIVING CIRCUIT

BACKGROUND OF THE INVENTION

1. Field of the Invention

The present invention relates to the field of display driving, and particularly to a scanning driving circuit.

2. Description of the Related Art

A Gate Driver On Array, GOA, has a scanning driving circuit produced on an array substrate of an existing thin film transistor liquid crystal display, and realizes a driving method of scanning the scanning lines line by line. The existing scanning driving circuit includes a pull-down control module, a pull-down module, a down link module, a bootstrap capacitor, and a reset control module.

When the scanning driving circuit works at a high temperature, delay and leakage problems often happen, thus affecting the dependability of the scanning driving circuit.

Therefore, it is necessary to provide a scanning driving circuit in order to solve the problems of the prior art.

SUMMARY OF THE INVENTION

The present invention aims to provide a scanning driving circuit with a simple structure and high dependability, to solve the technical problems of the complicated structure and low dependability of the existing scanning driving circuit.

To solve the aforementioned problems, the method provided by the present invention is as follows:

An embodiment of the present invention provides a scanning driving circuit for executing a driving operation to cascaded scanning lines, comprising:

a pull-down control module, for receiving a scanning signal of a previous stage, and generating a corresponding scanning voltage level signal with a low voltage level of the scanning line according to the scanning signal of the previous stage; or receiving a scanning signal of a next stage, and generating a corresponding scanning voltage level signal with the low voltage level of the scanning line according to the scanning signal of the next stage;

a pull-down module, for pulling down the corresponding scanning signal of the scanning line according to the scanning voltage level signal and a first predetermined clock signal;

a reset module, for receiving a second predetermined clock signal, and pulling up the corresponding scanning signal of the scanning line according to the second predetermined clock signal;

a downlink module, for generating and sending a clock signal of the present stage according to the scanning signal of the scanning line;

a first bootstrap capacitor, for generating the scanning voltage level signal of the scanning line with a low or high level;

a constant low voltage level source, for supplying the low voltage level signal; and a constant high voltage source for supplying the high voltage level signal;

wherein a cascading manner of the clock signal is determined according to a scanning order of the scanning driving circuit, for the reset module to pull up the corresponding scanning signal of the scanning line;

wherein the clock signal of each stage is equal to the clock signal of the previous stage separated by four stages;

the scanning driver circuit uses a P-type metal oxide semiconductor type transistor or an N-type metal oxide semiconductor type transistor to control the pull-down control module, the pull-down module, the reset module, and the downlink module.

In the scanning driving circuit of the present invention, when the scanning driving circuit is executing a forward scanning, the pull-down control module is used for receiving the scanning signal of the previous stage, and generating the corresponding scanning voltage level signal with the low voltage level of the scanning line according to the scanning signal of previous stage, the reset module receives the clock signal of the next stage, and pulls up the corresponding scanning signal of the scanning line according to the clock signal of the next stage.

In the scanning driving circuit of the present invention, when the scanning driving circuit is executing a backward scanning, the pull-down control module is used for receiving the scanning signal of the next stage, and generating the corresponding scanning voltage level signal with the low voltage level of the scanning line according to the scanning signal of the next stage, the reset module receives the clock signal of the previous stage, and pulls up the corresponding scanning signal of the scanning line according to the clock signal of the previous stage.

In the scanning driving circuit of the present invention, the pull-down control module includes a first switch and a second switch;

the scanning signal with the low voltage level is inputted to a control terminal of the first switch, the scanning signal of previous stage is inputted to an input terminal of the first switch; an output terminal of the first switch is connected to the pull-down module;

the scanning signal with the low voltage level is inputted to a control terminal of the second switch, the scanning signal of next stage is inputted to an input terminal of the second switch; an output terminal of the second switch is connected to the pull-down module.

In the scanning driving circuit of the present invention, the pull-down module includes a fifth switch, an input terminal of the fifth switch is connected to the pull-down control module, the first predetermined clock signal is inputted to a control terminal of the fifth switch tub, and an output terminal of the fifth switch is connected to the reset module.

In the scanning driving circuit of the present invention, the reset module includes a sixth switch, a seventh switch, an eighth switch, a ninth switch, a tenth switch, and a second bootstrap capacitor;

the second predetermined clock signal is inputted to a control terminal of the sixth switch, an input terminal of the sixth switch is connected to the constant low voltage level source, an output terminal of the sixth switch is connected to an output terminal of the ninth switch;

the scanning signal of previous stage or the scanning signal of next stage is inputted to a control terminal of the seventh switch, an input terminal of the seventh switch is connected to the constant high voltage level source, the output terminal of the sixth switch is connected to an output terminal of the seventh switch output terminal;

a control terminal of the eighth switch is connected to the output terminal of the sixth switch, an input terminal of the eighth switch is connected to the constant high voltage level source, an output terminal of the eighth switch is connected to the output terminal of the fifth switch;

a control terminal of the ninth switch is connected to the output terminal of the fifth switch, an input terminal of the ninth switch is connected to the constant high voltage level source;

a control terminal of the tenth switch is connected to the output terminal of the sixth switch, an input terminal of the tenth switch is connected to the constant high voltage level source, the scanning signal is outputted from the output terminal of the tenth switch of the present stage of the scanning line;

a terminal of the second bootstrap capacitor is connected to the constant high voltage level source, and the other terminal of the second bootstrap capacitor is connected to the control terminal of the tenth switch.

In the scanning driving circuit of the present invention, the scanning driving circuit further comprises:

a leak-proof module, the leak-proof module includes a twelfth switch, a control terminal of the twelfth switch is connected to the constant low voltage level source, an input terminal of the twelfth switch is connected to the output terminal of the fifth switch, and an output terminal of the twelfth switch is connected to the output terminal of the tenth switch through the first bootstrap capacitor.

In the scanning driving circuit of the present invention, the down link module includes an eleventh switch, a control terminal of the eleventh switch is connected to the output terminal of the twelfth switch, an input terminal of the eleventh switch is connected to the output terminal of the tenth switch, and the clock signal of the present stage is outputted from the output terminal of the eleventh switch.

An embodiment of the present invention provides a scanning driving circuit for executing a driving operation to cascaded scanning lines, comprising:

a pull-down control module, for receiving a scanning signal of a previous stage and generating a corresponding scanning voltage level signal with a low voltage level of the scanning line according to the scanning signal of the previous stage, or receiving a scanning signal of a next stage and generating a corresponding scanning voltage level signal with the low voltage level of the scanning line according to the scanning signal of the next stage;

a pull-down module, for pulling down the corresponding scanning signal of the scanning line according to the scanning voltage level signal and a first predetermined clock signal;

a reset module, for receiving a second predetermined clock signal, and pulling up the corresponding scanning signal of the scanning line according to the second predetermined clock signal;

a downlink module, for generating and sending a clock signal of the present stage according to the scanning signal of the scanning line;

a first bootstrap capacitor, for generating the scanning voltage level signal of the scanning line with a low or high level;

a constant low voltage level source, for supplying the low voltage level signal; and a constant high voltage source for supplying the high voltage level signal;

wherein a cascading manner of the clock signal is determined according to a scanning order of the scanning driving circuit, for the reset module to pull up the corresponding scanning signal of the scanning line.

In the scanning driving circuit of the present invention, when the scanning driving circuit is executing a forward scanning, the pull-down control module is used for receiving the scanning signal of the previous stage, and generating the corresponding scanning voltage level signal with the low voltage level of the scanning line according to the scanning signal of previous stage, the reset module receives the clock signal of the next stage, and pulls up the corresponding scanning signal of the scanning line according to the clock signal of the next stage.

In the scanning driving circuit of the present invention, when the scanning driving circuit is executing a backward scanning, the pull-down control module is used for receiving the scanning signal of the next stage, and generating the corresponding scanning voltage level signal with the low voltage level of the scanning line according to the scanning signal of the next stage, the reset module receives the clock signal of the previous stage, and pulls up the corresponding scanning signal of the scanning line according to the clock signal of the previous stage.

In the scanning driving circuit of the present invention, the clock signal of each stage is equal to the clock signal of the previous stage separated by four stages.

In the scanning driving circuit of the present invention, the pull-down control module includes a first switch and a second switch;

the scanning signal with the low voltage level is inputted to a control terminal of the first switch, the scanning signal of previous stage is inputted to an input terminal of the first switch; an output terminal of the first switch is connected to the pull-down module;

the scanning signal with the low voltage level is inputted to a control terminal of the second switch, the scanning signal of next stage is inputted to an input terminal of the second switch; an output terminal of the second switch is connected to the pull-down module.

In the scanning driving circuit of the present invention, the pull-down module includes a fifth switch, an input terminal of the fifth switch is connected to the pull-down control module, the first predetermined clock signal is inputted to a control terminal of the fifth switch tub, and an output terminal of the fifth switch is connected to the reset module.

In the scanning driving circuit of the present invention, the reset module includes a sixth switch, a seventh switch, an eighth switch, a ninth switch, a tenth switch, and a second bootstrap capacitor;

the second predetermined clock signal is inputted to a control terminal of the sixth switch, an input terminal of the sixth switch is connected to the constant low voltage level source, an output terminal of the sixth switch is connected to an output terminal of the ninth switch;

the scanning signal of previous stage or the scanning signal of next stage is inputted to a control terminal of the seventh switch, an input terminal of the seventh switch is connected to the constant high voltage level source, the output terminal of the sixth switch is connected to an output terminal of the seventh switch output terminal;

a control terminal of the eighth switch is connected to the output terminal of the sixth switch, an input terminal of the eighth switch is connected to the constant high voltage level source, an output terminal of the eighth switch is connected to the output terminal of the fifth switch;

a control terminal of the ninth switch is connected to the output terminal of the fifth switch, an input terminal of the ninth switch is connected to the constant high voltage level source;

a control terminal of the tenth switch is connected to the output terminal of the sixth switch, an input terminal of the tenth switch is connected to the constant high voltage level source, the scanning signal is outputted from the output terminal of the tenth switch of the present stage of the scanning line;

a terminal of the second bootstrap capacitor is connected to the constant high voltage level source, the other terminal of the second bootstrap capacitor is connected to the control terminal of the tenth switch.

In the scanning driving circuit of the present invention, the scanning driving circuit further comprises:

a leak-proof module, the leak-proof module includes a twelfth switch, a control terminal of the twelfth switch is connected to the constant low voltage level source, an input terminal of the twelfth switch is connected to the output terminal of the fifth switch, and an output terminal of the twelfth switch is connected to the output terminal of the tenth switch through the first bootstrap capacitor.

In the scanning driving circuit of the present invention, the down link module includes an eleventh switch, a control terminal of the eleventh switch is connected to the output terminal of the twelfth switch, an input terminal of the eleventh switch is connected to the output terminal of the tenth switch, and the clock signal of the present stage is outputted from the output terminal of the eleventh switch.

In the scanning driving circuit of the present invention, the scanning driver circuit uses a P-type metal oxide semiconductor type transistor or an N-type metal oxide semiconductor type transistor to control the pull-down control module, the pull-down module, the reset module, and the downlink module.

Compared to the existing scanning driving circuit, the scanning driving circuit of the present invention improves the dependability of the scanning driving circuit through the disposed reset module and clock signal, and the whole structure of the scanning driving circuit is simple, thus solving the technical problems of the complicated structure and low dependability of the existing scanning driving circuit.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Hereinafter, some embodiments of the present invention will be described with reference to the accompanying drawings. In the description of the elements of the present invention, the terms "first", "second", "A", "B", "(a)", "(b)", and the like may be used. These terms are merely used to distinguish one structural element from other structural elements, and a property, an order, a sequence, and the like of a corresponding structural element are not limited by the term. It should be noted that if it is described in the specification that one component is "connected", "coupled", or "joined" to another component, a third component may be "connected", "coupled", and "joined" between the first and second components, although the first component may be directly connected, coupled, or joined to the second component.

Figure 1:
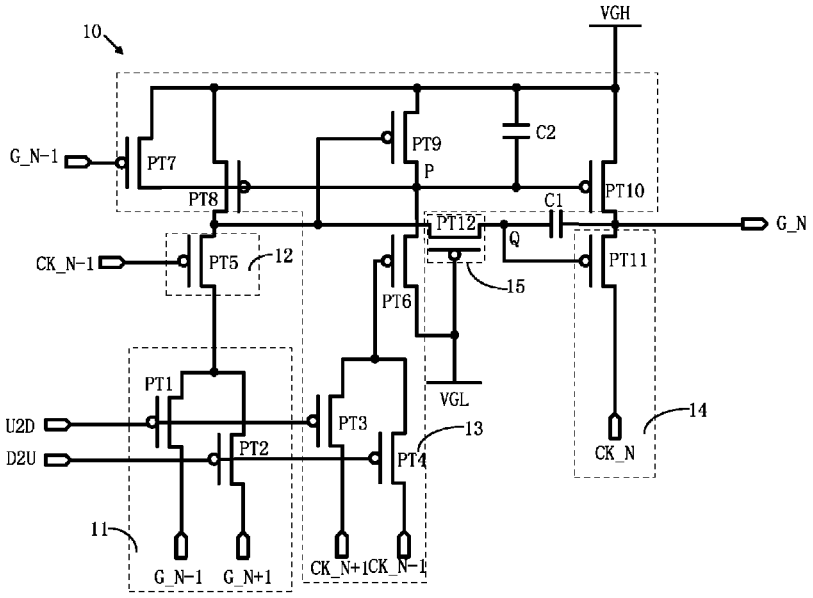
FIG. 1 illustrates a chart of the scanning driving circuit according to a first preferred embodiment of the present invention.

Please refer to FIG. 1. FIG. 1 illustrates a chart of the scanning driving circuit according to a first preferred embodiment of the present invention. The scanning driving circuit of the preferred embodiment is used for executing a driving operation to cascaded scanning lines. The scanning driving circuit 10 includes the pull-down control module 11, the pull-down module 12, the reset module 13, the downlink module 14, the first bootstrap capacitor C1, the constant low voltage level source VGL, the constant high voltage level source VGH and the leak-proof module 15.

The pull-down control module 11 is used for receiving the scanning signal G_N−1 of the previous stage, and generating the corresponding scanning voltage level signal with the low voltage level of the scanning line according to the scanning signal G_N−1 of previous stage; or receiving the scanning signal G_N+1 of next stage, and generating the corresponding scanning voltage level signal G_N+1 with the low voltage level of the scanning line according to the scanning signal of next stage. The pull-down module 12 is used for pulling down the scanning signal G_N of the corresponding scanning line according to the scanning voltage level signal and the first predetermined clock signal. The reset module is used for receiving the second predetermined clock signal, and pulling up the scanning signal G_N of the corresponding scanning line according to the second predetermined clock signal. The down link module is used for generating and sending the clock signal CK_N of the present stage according to the scanning signal G_N of the scanning line, generating and sending the clock signal CK_N of the present stage. The first bootstrap capacitor C1 is used for generating the scanning voltage level signal with the low voltage level or high voltage level of the scanning line. The constant low voltage level source VGL is used for providing the low voltage level signal. The constant high voltage level source VGH is used for providing the high voltage level signal.

The pull-down control module 11 of the scanning driving circuit 10 of the preferred embodiment includes the first switch PT1 and the second switch PT2, the scanning signal U2D with low voltage level is inputted to the control terminal of the first switch PT1, the scanning signal G_N−1 of previous stage is inputted to the input terminal of the first switch PT1, the output terminal of the first switch PT1 is connected to the pull-down module 12. The scanning signal D2U with low voltage level is inputted to the control terminal of the second switch PT2, the scanning signal G_N+1 of the next stage is inputted to the input terminal of the second switch PT2, the output terminal of the second switch PT2 is connected to the pull-down module 12.

The pull-down module 12 includes the fifth switch PT5, the input terminal of the fifth switch PT5 is connected to the pull-down control module 11, the first predetermined clock signal, for example, the clock signal CK_N−1 of previous stage, is inputted to the control terminal of the fifth switch PT5, the output terminal of the fifth switch PT5 is connected to the reset module 13.

The reset module 13 includes the third switch PT3, the fourth switch PT4, the sixth switch PT6, the seventh switch PT7, the eighth switch PT8, the ninth switch PT9, the tenth switch PT10, and the second bootstrap capacitor C2.

The scanning signal U2D with low voltage level is inputted to the control terminal of the third switch PT3, the clock signal CK_N+1 (that is, the second predetermined clock signal) of the next stage is inputted to the input terminal of the third switch PT3, the output terminal of the third switch PT3 is connected to the control terminal of the sixth switch PT6. The scanning signal D2U with the low voltage level is inputted to the control terminal of the fourth switch PT4, the clock signal CK_N−1 of previous stage (that is, the second predetermined clock signal) is inputted to the input terminal of the fourth switch PT4, the output terminal of the fourth switch PT4 is connected to the control terminal of the sixth switch PT6.

The second predetermined clock signal is inputted to the control terminal of the sixth switch PT6 through the third switch PT3 or the fourth switch PT4, the input terminal of the sixth switch PT6 is connected to the constant low voltage level source VHL, the output terminal of the sixth switch PT6 is connected to the output terminal of the ninth switch PT9.

The scanning signal G_N−1 of the previous stage or the scanning signal G_N+1 of the next stage is inputted to the seventh switch PT7, the input terminal of the seventh switch PT7 is connected to the constant high voltage level source VGH, the output terminal of the seventh switch PT7 is connected to the output terminal of the sixth switch PT6.

The control terminal of the eighth switch PT8 is connected to the output terminal of the sixth switch PT6, the input terminal of the eighth switch PT8 is connected to the constant high voltage level source VGH, the output terminal of the eighth switch PT8 is connected to the output terminal of the fifth switch PT5.

The control terminal of the ninth switch PT9 is connected to the output terminal of the fifth switch PT5, the input terminal of the ninth switch PT9 is connected to the constant high voltage level source VGH.

The control terminal of the tenth switch PT10 is connected to the output terminal of the sixth switch PT6, the input terminal of the tenth switch PT10 is connected to the constant high voltage level source VGH, the scanning signal G_N of the present stage of the scanning line is outputted from the output terminal of the tenth switch PT10.

A terminal of the second bootstrap capacitor C2 is connected to the constant high voltage level source VGH, the other terminal of the second bootstrap capacitor C2 is connected to the control terminal of the tenth switch PT10.

The leak-proof module 15 includes the twelfth switch PT12, the control terminal of the twelfth switch PT12 is connected to the constant low voltage level source VGL, the input terminal of the twelfth switch PT12 is connected to the output terminal of the fifth switch PT5, the output terminal of the twelfth switch PT12 is connected to the output terminal of the tenth switch PT10 through the first bootstrap capacitor C1.

The down link module 14 includes the eleventh switch PT11, the control terminal of the eleventh switch PT11 is connected to the output terminal of the twelfth switch PT12, the input terminal of the eleventh switch PT11 is connected to the output terminal of the tenth switch PT10, the clock signal CK_N of the present stage is outputted from the output terminal of the eleventh switch PT11.

The clock signal CK_N in the scanning driving circuit 10 of the preferred embodiment is outputted in a loop of four sets, that is, the waveforms of CK_N and CK_N+4 are the same. At first, the low voltage level signal is outputted from the scanning signal G_N−1 of the previous stage, then because the first switch PT1 of the pull-down control module 11 is under the control of the scanning signal U2D with the low voltage level, in a closed state; thus the scanning signal G_N−1 of the previous stage is outputted from the output terminal of the first switch PT1 and inputted to the input terminal of the second switch PT5 of the pull-down module 12. Meanwhile, the scanning signal D2U and the scanning signal U2D have opposite phases, when the second switch is under the control of the scanning signal U2D with the high voltage level, in an opened state.

Then the low voltage level signal CK_N−1 is inputted to the control terminal of the fifth switch PT5 of the pull-down module 12, thus the fifth switch PT5 is in a closed state, the low voltage level signal G_N−1 is outputted from the output terminal of the fifth switch PT5.

Meanwhile, the control terminal of the ninth switch PT9 of the reset module 14 receives the low voltage level signal G_N−1 outputted from the output terminal of the fifth switch PT5, thus the ninth switch PT9 is closed, the control terminal of the eighth switch PT8 and the control terminal of the tenth switch PT10 are respectively connected to the constant high voltage level source VGH through the ninth switch PT9, thus the eighth switch PT8 and the tenth switch PT10 are opened. Meanwhile, to assure that the eighth switch PT8 and the tenth switch PT10 are in an opened state, the seventh switch PT7 is closed under the control of the scanning signal G_N−1 of the previous stage, in order to assure that the control terminals of the eighth switch PT8 and the tenth switch PT10 are respectively connected to the constant high voltage level source VGH.

The twelfth switch PT12 of the leak-proof module 15 is closed under the control of the constant low voltage level source VGL, the low voltage level signal G_N−1 outputted from the fifth switch PT5 of the pull-down module 12 acts on the first bootstrap capacitor C1 through the twelfth switch PT12, makes the voltage level of point Q lower, thus the low voltage level signal is also outputted from G_N, meanwhile, the eleventh switch PT11 of the down link module 15 is also closed under the control of the voltage level of point Q, the clock signal CK_N with low voltage level of the present stage is outputted from the output terminal of the eleventh switch PT11 to the driving circuit of the scanning line of the previous stage.

When the clock signal CK_N+1 of the next stage becomes the low voltage level, the clock signal CK_N+1 of the next stage is inputted to the third switch PT3 of the reset module 13 under the control of the scanning signal U2D with the low voltage level. The clock signal CK_N+1 is outputted from the output terminal of the third switch PT3, that is, the reset signal is inputted to the control terminal of the sixth switch PT6.

The sixth switch PT6 of the reset module 13 is closed under the control of the reset signal, the constant low voltage level source VGL is inputted to the control terminals of the eighth switch PT8 and the tenth switch PT10 through the sixth switch PT6, wherein the eighth switch PT8 and the tenth switch PT10 are closed, the high voltage level signal of the constant high voltage level source VGH is inputted to point Q through the eighth switch PT8, pulling up the voltage level of point Q. Meanwhile, the high voltage level signal of the constant high voltage level source VGH is inputted to G_N through the tenth switch PT10, pulling up G_N, meanwhile because the eleventh switch PT11 is opened, the clock signal CK_N also becomes the high voltage level.

Then the cascading process of the scanning signal the with low voltage level of the scanning driving circuit 10 of the preferred embodiment is completed.

Preferably, the second bootstrap capacitor C2 disposed in the reset module 13 can further pull up the voltage levels of the control terminals of the eighth switch PT8 and the tenth switch PT10, thus further assure the low voltage level of point Q_N.

Preferably, the reset module 13 of the preferred embodiment further includes the fourth switch PT4, the scanning signal D2U with low voltage level is inputted to the control terminal of the fourth switch PT4, the clock signal CK_N−1 of the previous stage is inputted to the input terminal of the fourth switch PT4, the reset signal of the scanning line is outputted from the output terminal of the fourth switch PT4 to the sixth switch PT6. Thus the reset module 13 can receive the clock signal CK_N−1 of the previous stage, and generate the reset signal of the corresponding scanning line according to the clock signal CK_N−1 of previous stage CK_N−1.

Thus the scanning driving circuit 10 of the preferred embodiment can also realize the function of backward scanning through the second switch PT2 and the fourth switch PT4.

Figure 2:
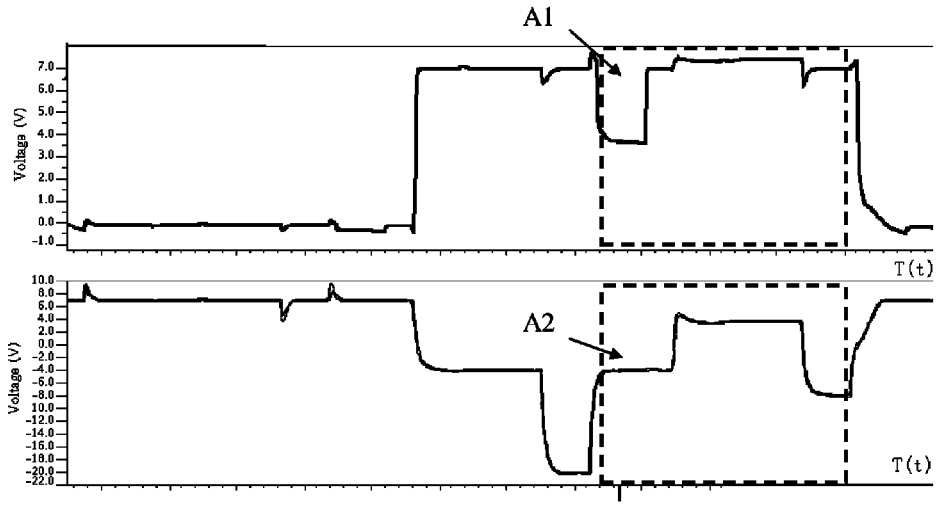
FIG. 2 illustrates voltage waveforms of points Q and P of the scanning driving circuit in FIG. 1.

Please refer to FIG. 2. FIG. 2 illustrates voltage waveforms of points Q and P of the scanning driving circuit in FIG. 1; wherein the upper side of FIG. 2 is the waveform chart of voltage level of point P in the scanning driving circuit, the bottom side of FIG. 2 is the waveform chart of voltage level of point Q in the scanning driving circuit. Because only the effective pull-down of the voltage level of point P can assure the effective pull-up of the voltage level of point Q, the G_N signal with the high voltage level is effectively recovered. A threshold voltage drift happens in the gate driving voltage of the sixth switch PT6 because of the third switch and the fourth switch, thus a pull-down current to point P from the sixth switch is decreased, meanwhile, the ninth switch has a pull-up current to point P, resulting in the voltage level of point P not being pulled down effectively, as in the region A1 in FIG. 2, the voltage level of point Q is thus not effectively pulled up and recovered, as in the region A2 in FIG. 2, the whole scanning driving circuit may thus be malfunction.

Figure 3A:
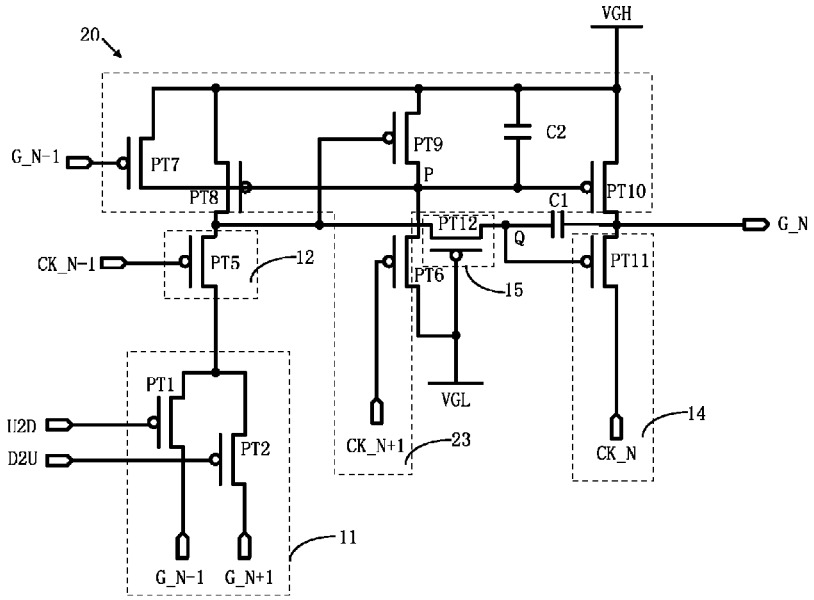
FIG. 3A illustrates a specific circuit chart of the scanning driving circuit executing the forward scanning according to a second preferred embodiment of the present invention.

Please refer to FIG. 3A. FIG. 3A illustrates a specific circuit chart of the scanning driving circuit executing the forward scanning according to a second preferred embodiment of the present invention. Based on the first preferred embodiment, the third switch and the fourth switch is removed from the reset module 23 of the scanning driving circuit 20 of the preferred embodiment, the second predetermined clock signal is directly inputted to the control terminal of the sixth switch PT6 of the reset module 23. Thus the affection of the third switch and the fourth switch to the gate driving voltage of the sixth switch PT6 can be avoided better. The type and cascading method of the second predetermined clock signal can be determined by the clock driving chip according to the order of scanning of the scanning driving circuit, for the reset module 23 to effectively pull up the scanning signal of the corresponding scanning line.

When the scanning driving circuit 20 of the preferred embodiment is executing a forward scanning, the pull-down control module 11 receives the scanning signal G_N−1 of the previous stage, and generates the corresponding scanning voltage level signal with the low voltage level of the scanning line according to the scanning signal G_N−1 of previous stage G_N−1, the reset module 23 receives the clock signal CK_N+1 of next stage, and pulls up the scanning signal G_N of the corresponding scanning line according to the clock signal CK_N+1 of the next stage.

The working principle of the scanning driving circuit 20 executing a forward scanning according to the preferred embodiment is similar or the same as the description in the first preferred embodiment of the scanning driving circuit 10 mentioned above; please refer to the relative description in the first preferred embodiment of the scanning driving circuit 10 above.

Figure 3B:
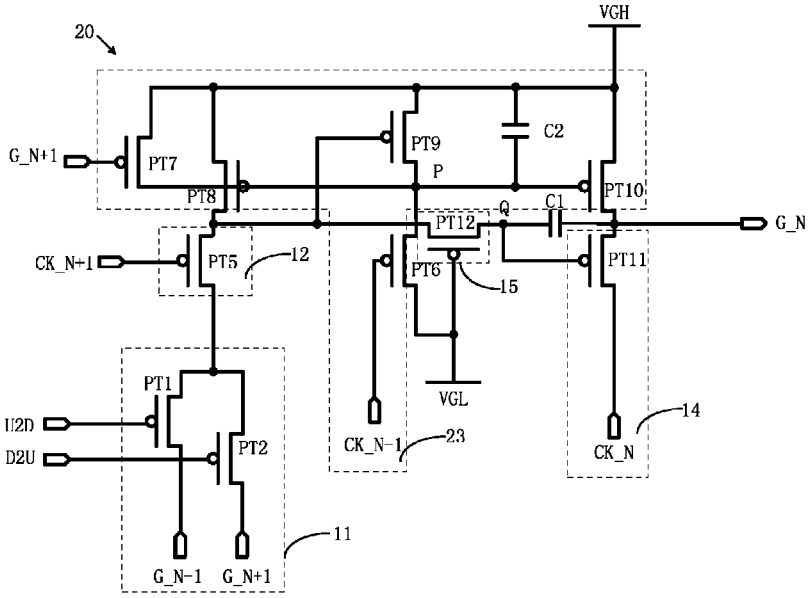
FIG. 3B illustrates a specific circuit chart of the scanning driving circuit executing the backward scanning according to the second preferred embodiment of the present invention.

Please refer to FIG. 3B. FIG. 3B illustrates a specific circuit chart of the scanning driving circuit executing the backward scanning according to the second preferred embodiment of the present invention. The difference between the backward scanning and the forward scanning is that, the pull-down control module 11 receives the scanning signal G_N+1 of the next stage, and generates the corresponding scanning voltage level signal with the low voltage level of the scanning line according to the scanning signal G_N+1 of the next stage. The reset module 23 receives the clock signal CK_N−1 of the previous stage, and pulls up the scanning signal G_N of the corresponding scanning line according to the clock signal CK_N−1 of the previous stage.

The working principle of the scanning driving circuit 20 executing a backward scanning according to the preferred embodiment is similar or the same as the description in the first preferred embodiment of the scanning driving circuit 10 mentioned above; please refer to the relative description in the first preferred embodiment of the scanning driving circuit 10 above.

Figure 4:
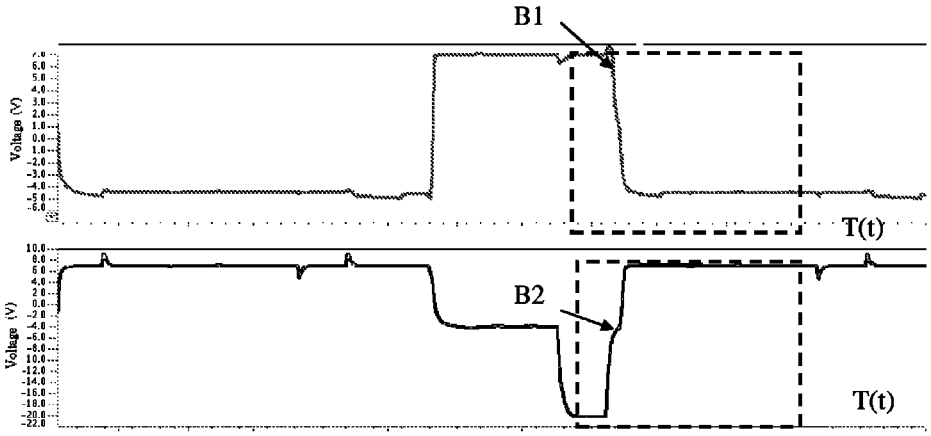
FIG. 4 illustrates voltage waveforms of points Q and P of the scanning driving circuit in FIG. 3A and FIG. 3B.

Please refer to FIG. 4. FIG. 4 illustrates voltage waveforms of points Q and P of the scanning driving circuit in FIG. 3A and FIG. 3B. The upper side of FIG. 4 is the waveform chart of voltage level of point P in the scanning driving circuit, the bottom side of FIG. 4 is the waveform chart of voltage level of point Q in the scanning driving circuit. As shown in the chart, because the third switch and the fourth switch are removed, the voltage level of point P is effectively pulled down, as shown in the region B1 in FIG. 4, and the voltage level of point Q is effectively pulled up, as shown in the region B2 in FIG. 4, thus the signal G_N with high voltage level being effectively recovered is realized, the fail of the scanning driving circuit is avoid.

Preferably, the scanning driver circuit 20 of the preferred embodiment uses a P-type metal oxide semiconductor type transistor to control the pull-down control module 11, the pull-down module 12, the reset module 23, the reset module 14 and the leak-proof module 15. Surely, an N-type metal oxide semiconductor type transistor can also be used to control the pull-down control module 11, the pull-down module 12, the reset module 23, the reset module 14, and the leak-proof module 15.

The scanning driving circuit of the present invention improves the dependability of the scanning driving circuit through the disposed reset module and clock signal, and the whole structure of the scanning driving circuit is simple, thus solving the technical problems of the complicated structure and low dependability of the existing scanning driving circuit.

In summary, although the present invention has been described in preferred embodiments described above, the preferred embodiments are not intended to limit the invention. Persons with ordinary skill in the art without departing from the spirit and scope of the invention otherwise, may be used for a variety modifications and variations, so the scope of the invention as defined by the claims shall prevail.

What is claimed is:

1. A scanning driving circuit for executing a driving operation for cascaded scanning lines, comprising:

a pull-down control module, for receiving a scanning signal of a previous stage, and generating a corresponding scanning voltage level signal with a low voltage level of the scanning line according to the scanning signal of the previous stage, or receiving a scanning signal of a next stage, and generating a corresponding scanning voltage level signal with the low voltage level of the scanning line according to the scanning signal of the next stage;

a pull-down module, for pulling down the corresponding scanning signal of the scanning line according to the scanning voltage level signal and a first predetermined clock signal;

a reset module, for receiving a second predetermined clock signal, and pulling up the corresponding scanning signal of the scanning line according to the second predetermined clock signal;

a downlink module, for generating and sending a clock signal of the present stage according to the scanning signal of the scanning line;

a first bootstrap capacitor, for generating the scanning voltage level signal of the scanning line with a low or high level;

a constant low voltage level source, for supplying the low voltage level signal; and a constant high voltage source for supplying the high voltage level signal;

wherein a cascading manner of the clock signals is determined according to a scanning order of the scanning driving circuit, for the reset module to pull up the corresponding scanning signal of the scanning line;

wherein the clock signal of each stage is equal to the clock signal of the previous stage separated by four stages;

the scanning driver circuit uses a P-type metal oxide semiconductor type transistor or an N-type metal oxide semiconductor type transistor to control the pull-down control module, the pull-down module, the reset module, and the downlink module.

2. The scanning driving circuit according to claim 1, wherein when the scanning driving circuit is executing a forward scanning, the pull-down control module is used for receiving the scanning signal of the previous stage, and generating the corresponding scanning voltage level signal with the low voltage level of the scanning line according to the scanning signal of previous stage, the reset module receives the clock signal of the next stage, and pulls up the corresponding scanning signal of the scanning line according to the clock signal of the next stage.

3. The scanning driving circuit according to claim 1, wherein when the scanning driving circuit is executing a backward scanning, the pull-down control module is used for receiving the scanning signal of the next stage, and generating the corresponding scanning voltage level signal with the low voltage level of the scanning line according to the scanning signal of the next stage, the reset module receives the clock signal of the previous stage, and pulls up the corresponding scanning signal of the scanning line according to the clock signal of the previous stage.

4. The scanning driving circuit according to claim 1, wherein the pull-down control module includes a first switch and a second switch;

the scanning signal with the low voltage level is inputted to a control terminal of the first switch, the scanning signal of previous stage is inputted to an input terminal of the first switch; an output terminal of the first switch is connected to the pull-down module;

the scanning signal with the low voltage level is inputted to a control terminal of the second switch, the scanning signal of next stage is inputted to an input terminal of the second switch; an output terminal of the second switch is connected to the pull-down module.

5. The scanning driving circuit according to claim 1, wherein the pull-down module includes a fifth switch, an input terminal of the fifth switch is connected to the pull-down control module, the first predetermined clock signal is inputted to a control terminal of the fifth switch tub, and an output terminal of the fifth switch is connected to the reset module.

6. The scanning driving circuit according to claim 5, wherein the reset module includes a sixth switch, a seventh switch, an eighth switch, a ninth switch, a tenth switch, and a second bootstrap capacitor;

the second predetermined clock signal is inputted to a control terminal of the sixth switch, an input terminal of the sixth switch is connected to the constant low voltage level source, an output terminal of the sixth switch is connected to an output terminal of the ninth switch;

the scanning signal of previous stage or the scanning signal of next stage is inputted to a control terminal of the seventh switch, an input terminal of the seventh switch is connected to the constant high voltage level source, the output terminal of the sixth switch is connected to an output terminal of the seventh switch output terminal;

a control terminal of the eighth switch is connected to the output terminal of the sixth switch, an input terminal of the eighth switch is connected to the constant high voltage level source, an output terminal of the eighth switch is connected to the output terminal of the fifth switch;

a control terminal of the ninth switch is connected to the output terminal of the fifth switch, an input terminal of the ninth switch is connected to the constant high voltage level source;

a control terminal of the tenth switch is connected to the output terminal of the sixth switch, an input terminal of the tenth switch is connected to the constant high voltage level source, the scanning signal is outputted from the output terminal of the tenth switch of the present stage of the scanning line; and a terminal of the second bootstrap capacitor is connected to the constant high voltage level source, the other terminal of the second bootstrap capacitor is connected to the control terminal of the tenth switch.

7. The scanning driving circuit according to claim 6, wherein the scanning driving circuit further comprises:

a leak-proof module, the leak-proof module includes a twelfth switch, a control terminal of the twelfth switch is connected to the constant low voltage level source, an input terminal of the twelfth switch is connected to the output terminal of the fifth switch, an output terminal of the twelfth switch is connected to the output terminal of the tenth switch through the first bootstrap capacitor.

8. The scanning driving circuit according to claim 7, wherein the down link module includes an eleventh switch, a control terminal of the eleventh switch is connected to the output terminal of the twelfth switch, an input terminal of the eleventh switch is connected to the output terminal of the tenth switch, and the clock signal of the present stage is outputted from the output terminal of the eleventh switch.

9. A scanning driving circuit for executing a driving operation to cascaded scanning lines, comprising:

a pull-down control module, for receiving a scanning signal of a previous stage, and generating a corresponding scanning voltage level signal with a low voltage level of the scanning line according to the scanning signal of the previous stage; or receiving a scanning signal of a next stage, and generating a corresponding scanning voltage level signal with the low voltage level of the scanning line according to the scanning signal of the next stage;

a pull-down module, for pulling down the corresponding scanning signal of the scanning line according to the scanning voltage level signal and a first predetermined clock signal;

a reset module, for receiving a second predetermined clock signal, and pulling up the corresponding scanning signal of the scanning line according to the second predetermined clock signal;

a downlink module, for generating and sending a clock signal of the present stage according to the scanning signal of the scanning line;

a first bootstrap capacitor, for generating the scanning voltage level signal of the scanning line with a low or high level;

a constant low voltage level source, for supplying the low voltage level signal; and a constant high voltage source for supplying the high voltage level signal;

wherein a cascading manner of the clock signal is determined according to a scanning order of the scanning driving circuit, for the reset module to pull up the corresponding scanning signal of the scanning line.

10. The scanning driving circuit according to claim 9, wherein when the scanning driving circuit is executing a forward scanning, the pull-down control module is used for receiving the scanning signal of the previous stage, and generating the corresponding scanning voltage level signal with the low voltage level of the scanning line according to the scanning signal of previous stage, the reset module receives the clock signal of the next stage, and pulls up the corresponding scanning signal of the scanning line according to the clock signal of the next stage.

11. The scanning driving circuit according to claim 9, wherein when the scanning driving circuit is executing a backward scanning, the pull-down control module is used for receiving the scanning signal of the next stage, and generating the corresponding scanning voltage level signal with the low voltage level of the scanning line according to the scanning signal of the next stage, the reset module receives the clock signal of the previous stage, and pulls up the corresponding scanning signal of the scanning line according to the clock signal of the previous stage.

12. The scanning driving circuit according to claim 9, wherein the clock signal of each stage is equal to the clock signal of the previous stage separated by four stages.

13. The scanning driving circuit according to claim 9, wherein the pull-down control module includes a first switch and a second switch;

the scanning signal with the low voltage level is inputted to a control terminal of the first switch, the scanning signal of previous stage is inputted to an input terminal of the first switch; an output terminal of the first switch is connected to the pull-down module;

the scanning signal with the low voltage level is inputted to a control terminal of the second switch, the scanning signal of next stage is inputted to an input terminal of the second switch; an output terminal of the second switch is connected to the pull-down module.

14. The scanning driving circuit according to claim 9, wherein the pull-down module includes a fifth switch, an input terminal of the fifth switch is connected to the pull-down control module, the first predetermined clock signal is inputted to a control terminal of the fifth switch tub, and an output terminal of the fifth switch is connected to the reset module.

15. The scanning driving circuit according to claim 14, wherein the reset module includes a sixth switch, a seventh switch, an eighth switch, a ninth switch, a tenth switch and a second bootstrap capacitor;

the second predetermined clock signal is inputted to a control terminal of the sixth switch, an input terminal of the sixth switch is connected to the constant low voltage level source, an output terminal of the sixth switch is connected to an output terminal of the ninth switch;

the scanning signal of previous stage or the scanning signal of next stage is inputted to a control terminal of the seventh switch, an input terminal of the seventh switch is connected to the constant high voltage level source, the output terminal of the sixth switch is connected to an output terminal of the seventh switch output terminal;

a control terminal of the eighth switch is connected to the output terminal of the sixth switch, an input terminal of the eighth switch is connected to the constant high voltage level source, an output terminal of the eighth switch is connected to the output terminal of the fifth switch;

a control terminal of the ninth switch is connected to the output terminal of the fifth switch, an input terminal of the ninth switch is connected to the constant high voltage level source;

a control terminal of the tenth switch is connected to the output terminal of the sixth switch, an input terminal of the tenth switch is connected to the constant high voltage level source, the scanning signal is outputted from the output terminal of the tenth switch of the present stage of the scanning line;

a terminal of the second bootstrap capacitor is connected to the constant high voltage level source, the other terminal of the second bootstrap capacitor is connected to the control terminal of the tenth switch.

16. The scanning driving circuit according to claim 15, wherein the scanning driving circuit further comprises:

a leak-proof module, the leak-proof module includes a twelfth switch, a control terminal of the twelfth switch is connected to the constant low voltage level source, an input terminal of the twelfth switch is connected to the output terminal of the fifth switch, and an output terminal of the twelfth switch is connected to the output terminal of the tenth switch through the first bootstrap capacitor.

17. The scanning driving circuit according to claim 16, wherein the downlink module includes an eleventh switch, a control terminal of the eleventh switch is connected to the output terminal of the twelfth switch, an input terminal of the eleventh switch is connected to the output terminal of the tenth switch, the clock signal of the present stage is outputted from the output terminal of the eleventh switch.

18. The scanning driving circuit according to claim 9, wherein the scanning driver circuit uses a P-type metal oxide semiconductor type transistor or an N-type metal oxide semiconductor type transistor to control the pull-down control module, the pull-down module, the reset module and the downlink module.

* * * * *